US007012376B2

(12) United States Patent
Yamashita et al.

(10) Patent No.: US 7,012,376 B2
(45) Date of Patent: Mar. 14, 2006

(54) FLUORESCENT LAMP LIGHTING DEVICE

(75) Inventors: Yoshiyuki Yamashita, Shiga-ken (JP); Kingo Ohmura, Kusatsu (JP); Atsuo Yokota, Hikone (JP); Masahiko Kawase, Yokaichi (JP); Shuji Tsubaki, Yokaichi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 17 days.

(21) Appl. No.: 10/687,693

(22) Filed: Oct. 20, 2003

(65) Prior Publication Data

US 2004/0085767 A1 May 6, 2004

(30) Foreign Application Priority Data

Oct. 31, 2002 (JP) ..... 2002-317973
Sep. 5, 2003 (JP) ..... 2003-314455
Sep. 10, 2003 (JP) ..... 2003-318318
Sep. 12, 2003 (JP) ..... 2003-321427

(51) Int. Cl.
*H01J 17/34* (2006.01)
*H01J 19/42* (2006.01)

(52) U.S. Cl. ..... 315/46; 313/272

(58) Field of Classification Search ..... 315/67, 315/64, 46, 246, 50, 51, 52, 49, 59, 60, 66–68, 315/112, 224, 72–75, 225; 313/272
See application file for complete search history.

(56) References Cited

U.S. PATENT DOCUMENTS 4,449,071 A * 5/1984 Yokoyama ..... 315/53
4,503,360 A * 3/1985 Bedel ..... 315/112
4,518,895 A * 5/1985 Lehman ..... 315/117
5,066,892 A * 11/1991 Bouchard et al. ..... 315/46
5,621,266 A * 4/1997 Popov et al. ..... 313/46
5,977,692 A * 11/1999 Itaya et al. ..... 313/37
6,191,539 B1 * 2/2001 Green ..... 315/249
6,411,524 B1 * 6/2002 Chen et al. ..... 361/803
6,469,447 B1 * 10/2002 Nakagawa et al. ..... 315/46
6,600,272 B1 * 7/2003 Matsui et al. ..... 315/246
2002/0125834 A1 * 9/2002 Shoji et al. ..... 315/224

FOREIGN PATENT DOCUMENTS

JP 2000-286088 * 10/2000
JP 2001-035675 * 2/2001
JP 2001-357989 12/2001

* cited by examiner

*Primary Examiner*—Wilson Lee
*Assistant Examiner*—Angela M Lie
(74) *Attorney, Agent, or Firm*—Keating & Bennett, LLP

(57) ABSTRACT

A fluorescent lamp lighting device includes a fluorescent light bulb having an electrode filament and an electronic lighting circuit substrate for lighting the fluorescent light bulb, wherein a capacitor connected in parallel with the fluorescent light bulb, a positive characteristic thermistor connected in parallel with the capacitor, and a negative characteristic thermistor connected in parallel with the electrode filament are mounted on the electronic lighting circuit substrate, and wherein the negative characteristic thermistor, having a mounting surface, is mounted in such a manner that the mounting surface is in abutment with the electronic lighting circuit substrate. The positive characteristic thermistor and the negative characteristic thermistor are preferably mounted on mutually different mounting surfaces among the two mounting surfaces of the obverse and reverse surfaces of the electronic lighting circuit substrate.

32 Claims, 4 Drawing Sheets

FLUORESCENT LAMP LIGHTING DEVICE

BACKGROUND OF THE INVENTION

1. Field of the Invention

The present invention relates to a fluorescent lamp lighting device for lighting a fluorescent light bulb by using an electronic lighting circuit.

2. Description of the Related Art

In recent years, as fluorescent lamp lighting devices, inverter-type electronic lighting devices have been commonly used in order to save energy. In particular, in fluorescent lamps incorporated in a lighting device, which is an energy-saving light source, in order to achieve higher-efficiency of a lamp, inverter-type electronic lighting circuits are becoming increasingly used.

Japanese Unexamined Patent Application Publication No. 2001-357989 discloses a known fluorescent lamp. That is, ordinary fluorescent lamps are configured as shown in FIG. 3. A circuit substrate 20 on which an electronic lighting circuit 3 is formed is arranged between a base 6 arranged at the end portion of a resin case 5 and a fluorescent light bulb 2, and electronic components for insertion mounting are mounted on the circuit substrate 20.

Furthermore, a known fluorescent lamp has an electronic lighting circuit shown in FIG. 2. The configuration of the circuit will now be described below with reference to FIG. 2.

The electronic lighting circuit 3 includes a fluorescent light bulb 2, a power source 13, and an inverter circuit section 14. A terminal "a" of one of electrode filaments 7 contained in the fluorescent light bulb 2 is directly connected to the inverter circuit section 14. Furthermore, a terminal a' of the other electrode filament 8 contained in the fluorescent light bulb 2 is connected in series to the inverter circuit section 14 via an inductance element 15 for controlling electrical current. A capacitor 18 and a positive characteristic thermistor (hereinafter referred to as a "PTC thermistor") 19 are connected in parallel between a terminal b of the electrode filament 7 and the terminal b' of the electrode filament 8. Furthermore, a negative characteristic thermistor (hereinafter referred to as an "NTC thermistor") 16 is connected between the terminals a and b of the electrode filament 7, and an NTC thermistor 17 is connected between the terminals a' and b' of the electrode filament 8.

On the surface of the fluorescent lamp that faces the base of the circuit substrate, comparatively large electronic components for insertion mounting, such as a smoothing capacitor, a resonance capacitor, a resonance coil, a PTC thermistor, and an NTC thermistor, are mounted, and the components are in close proximity with each other.

Here, in a case where, after the fluorescent lamp is temporarily lit normally, the power supply is switched off, the cooling speed of the NTC thermistor differs according to how close the NTC thermistor is to the other components.

Furthermore, when a component which is close to an NTC thermistor is a self-heating component, such as a PTC thermistor, it becomes difficult for the NTC thermistor to cool due to the self-heating, and the off time required to maintain the pre-heating efficiency of the filament, that is, the reset time, becomes long.

Therefore, at the restarting time, since it is difficult to ensure pre-heating current which flows through the electrode filament, there is a risk in that the number of on-off operations of the lamp may be decreased due to insufficient pre-heating.

SUMMARY OF THE INVENTION

In order to overcome the problems described above, preferred embodiments of the present invention provide a fluorescent lamp lighting device in which the problem of the reset time becoming long is overcome and a decrease in the number of on-off operations of the lamp can be prevented.

According to a preferred embodiment of the present invention, a fluorescent lamp lighting device includes a fluorescent light bulb having an electrode filament, and an electronic lighting circuit substrate for lighting the fluorescent light bulb, wherein a capacitor connected in parallel with the fluorescent light bulb, a positive characteristic thermistor connected in parallel with the capacitor, and a negative characteristic thermistor connected in parallel with the electrode filament are mounted on the electronic lighting circuit substrate, and wherein a mounting surface of the negative characteristic thermistor is mounted such that the mounting surface is in abutment with the electronic lighting circuit substrate.

The electronic lighting circuit substrate has obverse and reverse surfaces, and the positive characteristic thermistor and the negative characteristic thermistor are preferably mounted on mutually different mounting surfaces among the two mounting surfaces of the obverse and reverse surfaces of the electronic lighting circuit substrate.

According to the fluorescent lamp lighting device of various preferred embodiments of the present invention, the advantages described below are obtained.

Since a surface-mount-type NTC thermistor is used, when compared to a reed-type NTC thermistor, generated heat is easily radiated to the circuit substrate, and thus, the device can easily return to room temperature. As a result, at the restarting time, the surface-mount-type NTC thermistor is more likely to return to a state in which the resistance value is high, and before the lamp is started, a state in which pre-heating current flows through an electrode filament coil can be reached more quickly.

Furthermore, in the fluorescent lamp lighting device of preferred embodiments of the present invention, since the surface-mount-type NTC thermistor is surface-mounted on the circuit substrate surface on the side opposing the PTC thermistor so that the surface-mount-type NTC thermistor does not come close to self-heating components of the PTC thermistor, the problem of the reset time becoming long does not occur.

Therefore, it becomes easier to ensure pre-heating current which flows through the electrode filament. Also, a decrease in the number of on-off operations of the lamp due to insufficient pre-heating can be prevented.

Other features, elements, characteristics and advantages of the present invention will become more apparent from the following detailed description of preferred embodiments with reference to the attached drawings.

DETAILED DESCRIPTION OF PREFERRED EMBODIMENTS

Figure 1:
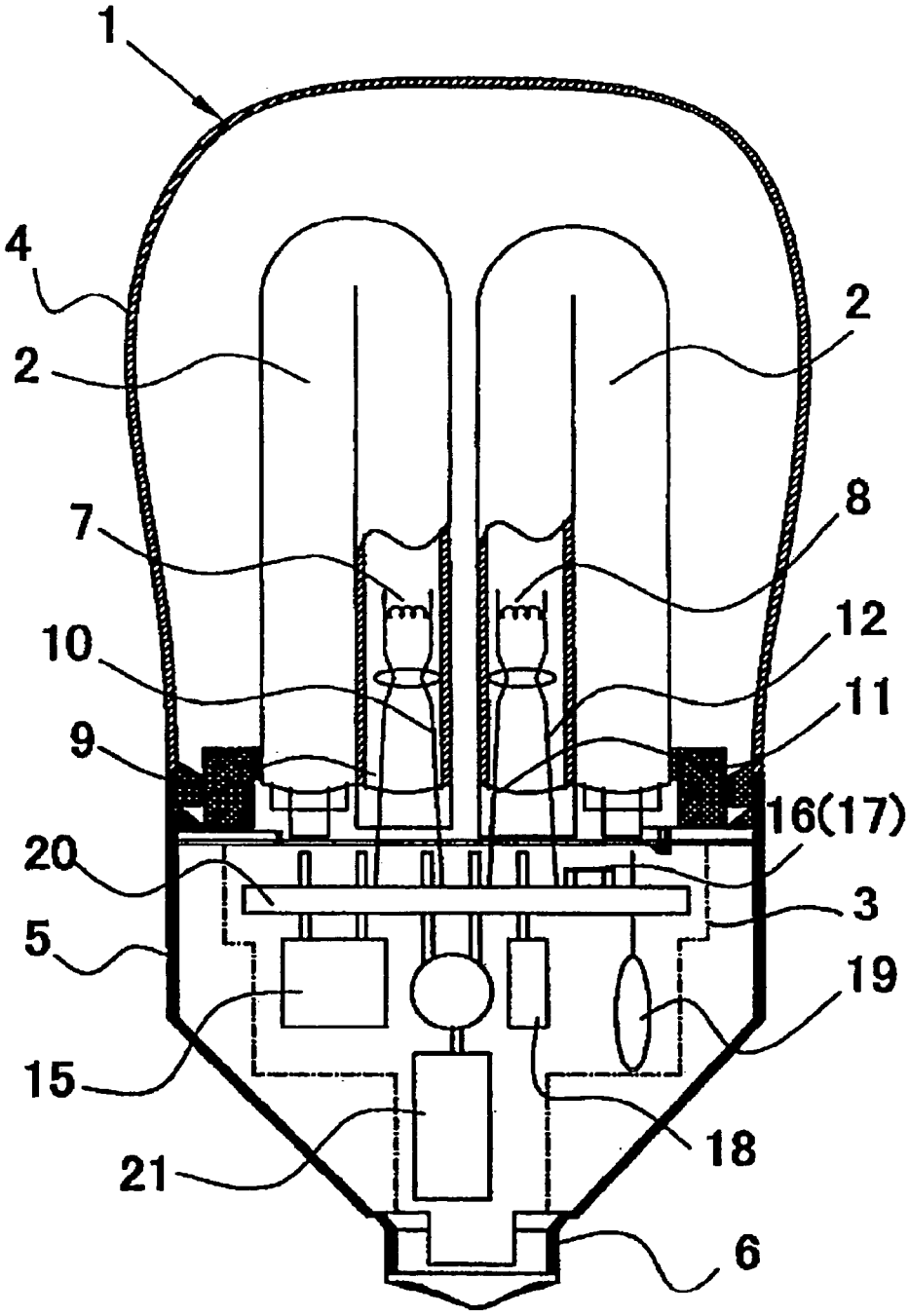
FIG. 1 is an overall sectional view showing the configuration of a fluorescent lamp in which a fluorescent lamp lighting device according to a preferred embodiment of the present invention is used.

The configuration of a fluorescent lamp lighting device of a preferred embodiment will be described first. FIG. 1 is a sectional view showing the configuration of a fluorescent lamp lighting device according to this preferred embodiment.

An electric-lamp-type fluorescent lamp 1 includes a fluorescent light bulb 2, an external-tube glass bulb 4 which covers the fluorescent light bulb 2, a resin case 5 connected to the base-portion side of the external-tube glass bulb 4, an electronic lighting circuit 3 housed in the resin case 5, and a base 6 arranged at the end portion of the resin case 5. The fluorescent light bulb 2 preferably includes four substantially U-shaped glass tubes (only two substantially U-shaped glass tubes are shown in the figure).

Figure 2:
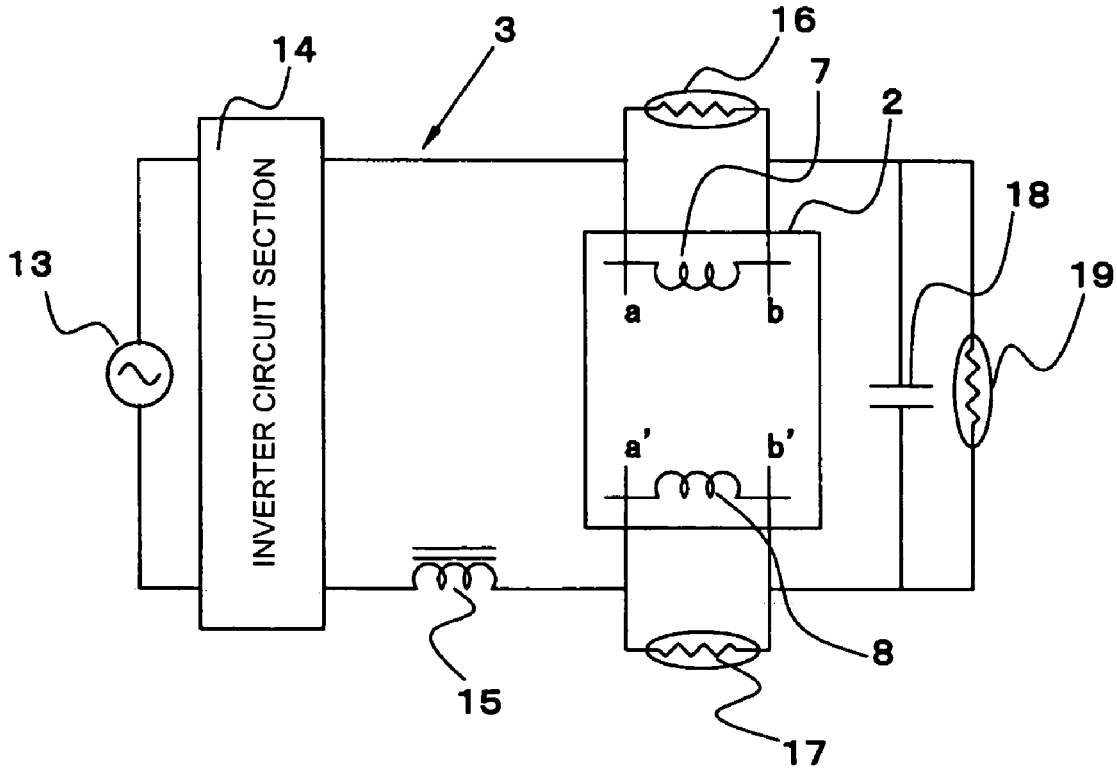
FIG. 2 PRIOR ART
FIG. 2 is an electronic lighting circuit diagram.
Figure 3:
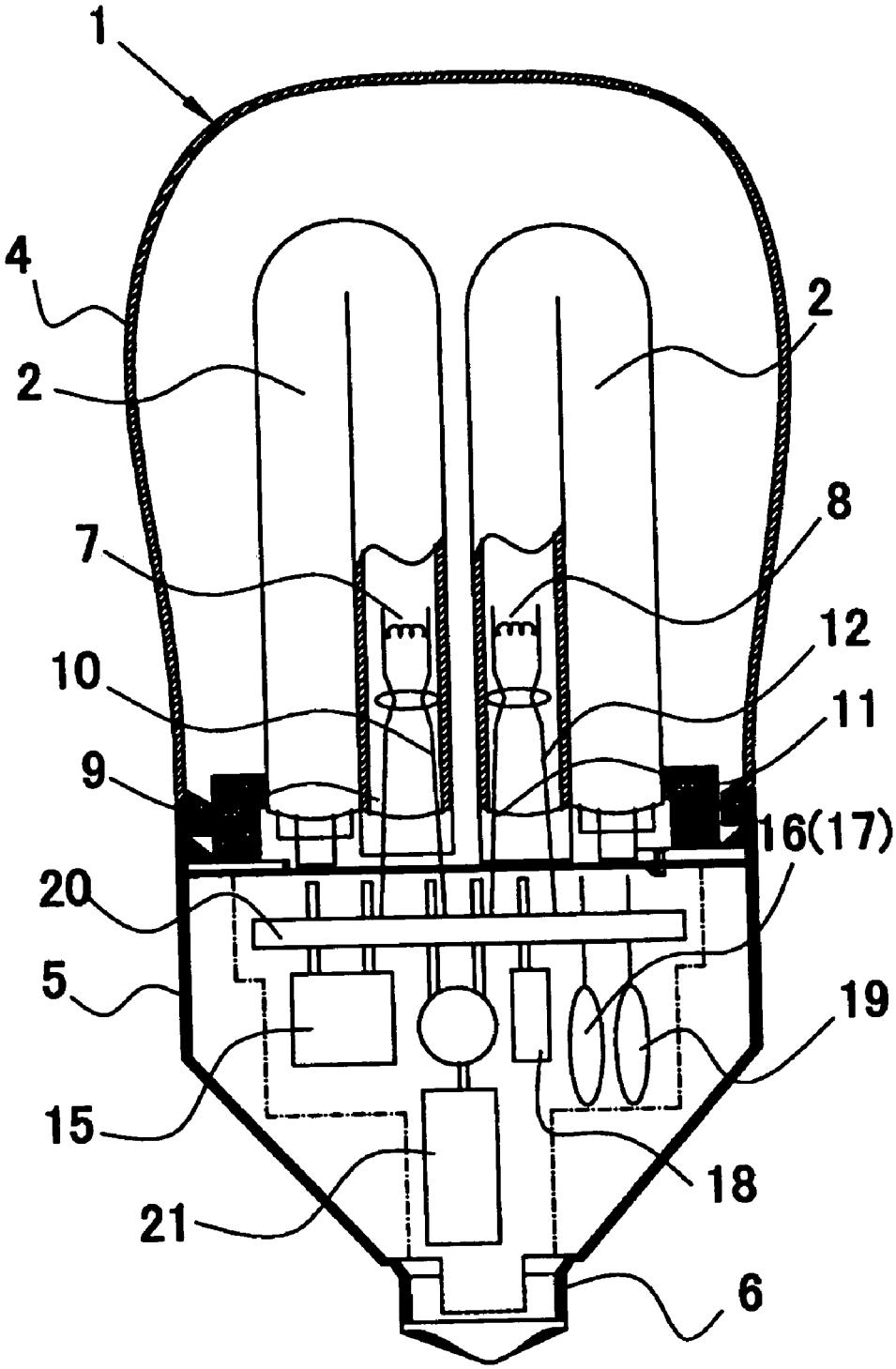
FIG. 3 PRIOR ART
FIG. 3 is an overall sectional view showing the configuration of a fluorescent lamp in which a known fluorescent lamp lighting device is used.

A description will also be given with reference to FIG. 2. The fluorescent light bulb 2 is provided with a pair of electrode filaments 7 and 8. Inside one of the tube end portions of the fluorescent light bulb 2, one of the electrode filaments 7 is held by a pair of reed lines 9 and 10. Furthermore, inside the other tube end portion of the fluorescent light bulb, the other electrode filament 8 is held by a pair of reed lines 11 and 12. The reed lines 9 to 12 are led outside the fluorescent light bulb 2 and are each electrically connected to the electronic lighting circuit 3 provided inside the resin case 5. The electronic lighting circuit 3 is formed by a series inverter circuit method, and is connected to the power supply 13 via the base 6 arranged at the end portion of the resin case 5.

The electronic lighting circuit 3 has an inverter circuit section 14 driven by the power supply 13 so as to light the fluorescent light bulbs 2. The terminal a of one of the electrode filaments 7 included in the fluorescent light bulb 2 is directly connected to the inverter circuit section 14. Furthermore, the terminal a' of the other electrode filament 8 is connected to the inverter circuit section 14 via an inductance element 15, which is connected in series, for controlling electrical current. The capacitor 18 is connected in parallel with the fluorescent light bulb 2, and a PTC thermistor 19 is connected in parallel with the capacitor 18. Furthermore, an NTC thermistor 16 is connected in parallel between the terminals a and b of the electrode filament 7, and an NTC thermistor 17 is connected in parallel between the terminals a' and b' of the filament 8.

Figure 4:
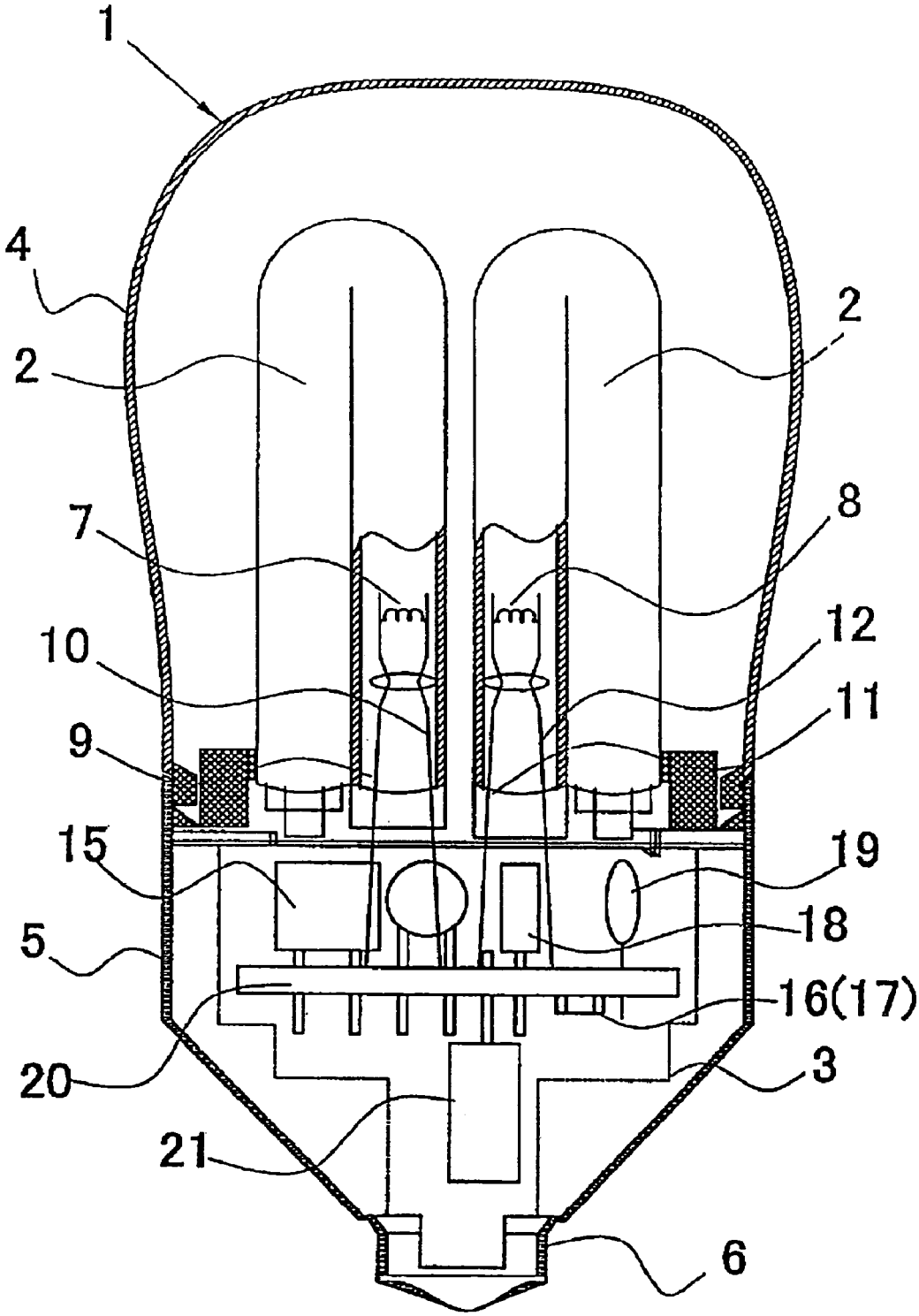
FIG. 4 is an overall sectional view showing an alternative configuration of a fluorescent lamp in which a fluorescent lamp lighting device according to a preferred embodiment of the present invention is used.

The NTC thermistors 16 and 17 are surface-mounted on the same surface, which faces the fluorescent light bulb 2 of the circuit substrate 20, as that of the electronic lighting circuit 3 housed in the resin case 5. Furthermore, on the surface of the circuit substrate 20 that faces the base 6, electronic components for insertion mounting (for example, the inductance element 15, the capacitor 18, and the PTC thermistor 19) are mounted. Here, it is important that the NTC thermistors 16 and 17 have a mounting surface and are mounted in such a manner that this mounting surface is placed in abutment with the circuit substrate 20. Hereinafter, these thermistors 16 and 17 will also be described as the surface-mount type NTC thermistor, and when described as a surface-mount type, this is assumed to be used to implicate the foregoing. Although in this preferred embodiment, an NTC thermistor is mounted on the fluorescent light bulb side of the circuit substrate and the PTC thermistor is mounted on the base side, the configuration is not limited to the above configuration, and even when, contrary to the above-described configuration, the PTC thermistor is mounted on the fluorescent light bulb side of the circuit substrate and the NTC thermistor is mounted on the base side as shown in FIG. 4, similar advantages are obtained.

Next, a description will be given of the operation from when the fluorescent light bulb 2 is pre-heated until it is normally lit in the electronic lighting circuit.

First, the PTC thermistor 19 is in a state in which the temperature thereof is low before the lamp is started and the resistance value thereof is low. At this time, the temperature of the NTC thermistors 16 and 17 which are connected in parallel with the electrode filaments 7 and 8, respectively, is also low, and the resistance values thereof are high.

Next, when the power-supply switch is turned on, AC current is supplied from the power supply 13, and pre-heating current flows through the electrode filaments 7 and 8 of the fluorescent light bulb 2. At this stage before the lamp is started, since the resistance value of the PTC thermistor 19 is low, the pre-heating current flows through the PTC thermistor 19 having a resistance value lower than that of the capacitor 18, the pre-heating current can be set to a high value. On the other hand, at this stage, since the resistance values of the NTC thermistor thermistors 16 and 17 are high, most of the pre-heating current before the lamp is started flows through the electrode filaments 7 and 8. At this time, the resistance value of the PTC thermistor 19 is low, hardly any resonance voltage is generated between the capacitor 18 and the inductance element 15, and a starting voltage is not applied to the fluorescent light bulb 2.

Next, when the temperature of the PTC thermistor 19 sharply increases with the self-heating due to the pre-heating current and the resistance value thereof sharply increases, a starting voltage corresponding to the resonance voltage of the capacitor 18 is applied to the fluorescent light bulb 2, and the fluorescent light bulb 2 is started. In this case, the temperature of the NTC thermistors 16 and 17 increases, the resistance values thereof sharply decrease, and each of the electrode filaments 7 and 8 is short-circuited.

Furthermore, at the normally lit time, since the resistance values of the NTC thermistors 16 and 17 are low, the electrical current via the capacitor 18 does not flow through the electrode filaments 7 and 8, and most of the electrical current flows through the NTC thermistors 16 and 17.

For the NTC thermistor, an NTC thermistor, having an external electrode made of Ag on the end surface of a plain ceramic body, with a room temperature resistance of about 60Ω and a B constant of about 3800K (between about 25° C. and about 50° C.), is preferably used. However, any kind having a shape which can be surface-mounted on the circuit substrate may be used, and the characteristics are not limited to the above-described ones.

According to the above-described configuration, the electrode filaments 7 and 8 can be efficiently pre-heated within one second before the lamp is started, and sufficient thermionic radiation can be obtained. As a result, the application of the starting voltage allows the lamp to be started quickly, the glow discharge time immediately after the lamp is started is shortened, and the amount of electron radiation material scattered from the electrode filaments 7 and 8 can be reduced. Furthermore, since the electrode filaments at the normally lit time can be efficiently pre-heated, it is possible to shorten the starting time.

Here, a description will be given in detail of advantages as a result of surface-mounting a surface-mount-type NTC thermistor on the surface of a circuit substrate in the fluorescent lamp lighting device according to preferred embodiments of the present invention.

First, the filament pre-heating improvement effect when the fluorescent lamp lighting device is lit again was examined. As one measure for knowing the filament pre-heating improvement effect, the glow discharge time was used. A glow discharge is a discharge phenomenon which occurs because it becomes difficult for electrons to move about in a state in which the filament is not warmed, that is, pre-heating is insufficient, when a voltage is applied to light a fluorescent lamp. In general, it is known that, the smaller the glow discharge time, the more there is a pre-heating effect, and by measuring the glow discharge time when the fluorescent lamp lighting device is lit, it is possible to know the filament pre-heating improvement effect when the fluorescent lamp lighting device is lit again.

As evaluation samples, four types of a case in which an NTC thermistor which is surface-mounted on the base side is used (a first preferred embodiment), a case in which an NTC thermistor which is surface-mounted on the fluorescent light bulb side is used (a second preferred embodiment), a case in which a reed-type NTC thermistor which is mounted on the base side is used (comparative example 1), and a case in which a reed-type NTC thermistor which is mounted on the fluorescent light bulb side is used (comparative example 2) were used. More specifically, for the fluorescent lamp lighting device, a fluorescent lamp lighting device of 22-watt type was used. The first preferred embodiment is arranged such that surface-mount-type NTC thermistors are connected in parallel with two filaments correspondingly, and are surface-mounted on the surface of the circuit substrate that faces the base, and the PTC thermistor and the NTC thermistor are mounted on the same surface. The second preferred embodiment is arranged such that surface-mount-type NTC thermistors are connected in parallel with two filaments correspondingly, and are surface-mounted on the surface of the circuit substrate that faces the fluorescent light bulb, and the PTC thermistor and the NTC thermistor are mounted on different surfaces. Comparative example 1 is arranged such that reed-type NTC thermistors are connected in parallel with two filaments correspondingly, and are surface-mounted on the surface of the circuit substrate that faces the base. Comparative example 2 is arranged such that reed-type NTC thermistors are connected in parallel with two filaments correspondingly, and are surface-mounted on the surface of the circuit substrate that faces the fluorescent light bulb. Since the evaluation was made by using the NTC thermistors, all of which having the same shape and having the same resistance value, an effect due to the size can be ignored.

Here, the fluorescent lamp lighting device was left in an ambient environment at an ambient temperature of about 25° C. with no air movement, and the temperature of the fluorescent lamp lighting device was stabilized. Thereafter, an input voltage of about 100 Vrms/60 Hz was applied at a cycle of 10 seconds ON-170 seconds OFF, and assuming the above-mentioned cycle to be one cycle, the glow discharge time for each cycle was measured. The glow discharge time was measured from the waveform of the electrical current which flows through the filament when the input voltage is ON. The measured results are shown in Table 1.

TABLE 1

| | Number of Cycles | | | | | | | | | |
|---|---|---|---|---|---|---|---|---|---|---|
| | 1 | 2 | 3 | 4 | 5 | 6 | 7 | 8 | 9 | 10 |
| First Preferred Embodiment | 0 | 0 | 0 | 0 | 0 | 0 | 0 | 0 | 0 | 0 |
| Second Preferred Embodiment | 0 | 0 | 0 | 0 | 0 | 0 | 0 | 0 | 0 | 0 |
| Comparative Example 1 | 0 | 0 | 9 | 0 | 13 | 14 | 23 | 27 | 33 | 26 |
| Comparative Example 2 | 0 | 0 | 0 | 0 | 22 | 15 | 21 | 16 | 23 | 25 |

| | Number of Cycles | | | | | | | | | |
|---|---|---|---|---|---|---|---|---|---|---|
| | 11 | 12 | 13 | 14 | 15 | 16 | 17 | 18 | 19 | 20 |
| First Preferred Embodiment | 0 | 0 | 0 | 0 | 9 | 13 | 17 | 16 | 17 | 18 |
| Second Preferred Embodiment | 0 | 0 | 0 | 0 | 0 | 0 | 0 | 0 | 0 | 0 |
| Comparative Example 1 | 27 | 25 | 28 | 35 | 34 | 38 | 32 | 37 | 33 | 39 |
| Comparative Example 2 | 25 | 17 | 17 | 16 | 19 | 26 | 18 | 18 | 29 | 28 |

As is also clear from Table 1, when the reed-type NTC thermistor was used, glow discharge occurred within five cycles when either on the surface of the circuit substrate that faces the base side or on the surface facing the fluorescent light bulb side the reed-type NTC thermistor was mounted.

However, in a case where the surface-mount-type NTC thermistor was used, in the first preferred embodiment in which it was surface-mounted on the base side, glow discharge did not occur for up to 14 cycles, and in the second preferred embodiment in which it was surface-mounted on the fluorescent light bulb side, glow discharge did not occur even at 20 cycles.

It can be clearly seen from these results that a considerable filament pre-heating improvement effect of the filament when the electric-lamp-type fluorescent lamp lighting device is lit again is obtained.

Preferably, the PTC thermistor and the NTC thermistor are mounted on mutually different mounting surfaces among the two mounting surfaces of the obverse and reverse surfaces of the electronic lighting circuit substrate.

Next, by using an evaluation sample of conditions similar to the above-described ones, the number of on-off operations of the fluorescent lamp lighting device was examined. Also, for the fluorescent lamp lighting device, a fluorescent lamp lighting device similar to the above-described one was used.

As the measurement conditions, the fluorescent lamp lighting device was left in an ambient environment at an ambient temperature of about 25° C. with no air movement, so that the temperature of the fluorescent lamp lighting device was stabilized. Thereafter, an input voltage of 100 Vrms/60 Hz was applied at a cycle of 10 seconds ON-170 seconds OFF. Assuming the above-mentioned cycle to be one cycle, the number of possible on-and-off cycles was measured. The measured results are shown in Table 2.

TABLE 2

| | Number of Cycles |
|---|---|
| First Preferred Embodiment | 41,000 |
| Second Preferred Embodiment | 48,000 |
| Comparative Example 1 | 23,000 |
| Comparative Example 2 | 23,000 |

As is also clear from Table 2, when the reed-type NTC thermistor was used, the number of on-off operations was approximately 23,000 cycles when either on the surface of the circuit substrate that faces the base side or on the surface facing the fluorescent light bulb side the reed-type NTC thermistor was mounted.

However, in a case where the surface-mount-type NTC thermistor was used, in the first preferred embodiment in which it is surface-mounted on the base side, the number of on-off operations was 41,000 cycles, and in the second preferred embodiment in which it is surface-mounted on the fluorescent light bulb side, the number of on-off operations was 48,000 cycles.

It can be known from these results that, as a result of using the surface-mount-type NTC thermistor, the number of on-off operations of the CFL (Compact Fluorescent Light) is improved considerably.

Preferably, the PTC thermistor and the NTC thermistor are mounted on mutually different mounting surfaces among the two mounting surfaces of the obverse and reverse surfaces of the electronic lighting circuit substrate. In the first preferred embodiment, each of the NTC thermistors 16 and 17 is connected between the terminals a and b of the electrode filament 7 and between the terminals a' and b' of the electrode filament 8, respectively. Alternatively, the configuration may be arranged in such a way that a plurality of NTC thermistors 16 are connected in parallel and a plurality of NTC thermistors 17 are connected in parallel. In this case, at least one of the plurality of NTC thermistors 16 and the plurality of NTC thermistors 17 may be connected in parallel.

With such a configuration of the electronic lighting circuit, electrical current flows through each of a plurality of NTC thermistors when a fluorescent lamp is switched on, and when compared to the case of one NTC thermistor, the heat-generating temperature of each NTC thermistor can be decreased, making it possible to further reduce the influence of heat exerted on the other components. Furthermore, since the heat-generating temperature of each NTC thermistor is decreased, the service life of electronic components can be improved further.

The present invention is not limited to each of the above-described preferred embodiments, and various modifications are possible within the range described in the claims. An embodiment obtained by appropriately combining technical features disclosed in each of the different preferred embodiments is included in the technical scope of the present invention.

What is claimed is:

1. A fluorescent lamp lighting device comprising:

a fluorescent light bulb having an electrode filament; and an electronic lighting circuit substrate for lighting the fluorescent light bulb; wherein a capacitor connected in parallel with said fluorescent light bulb, a positive temperature characteristic thermistor connected in parallel with the capacitor, and a negative temperature characteristic thermistor connected in parallel with said electrode filament are mounted on said electronic lighting circuit substrate;

said negative characteristic thermistor has a mounting surface that is mounted in such a manner that said mounting surface is in abutment with said electronic lighting circuit substrate; and said electronic lighting substrate has obverse and reverse surfaces with mounting surfaces thereon, and said positive characteristic thermistor and said negative characteristic thermistor are mounted on mutually different mounting surfaces among the two mounting surfaces of the obverse and reverse surfaces of said electronic lighting circuit substrate.

2. A fluorescent lamp lighting device according to claim 1, further comprising an external-tube glass bulb which covers the fluorescent light bulb.

3. A fluorescent lamp lighting device according to claim 2, further comprising a resin case connected to the external-tube glass bulb.

4. A fluorescent lamp lighting device according to claim 3, further comprising an electronic lighting circuit housed in the resin case.

5. A fluorescent lamp lighting device according to claim 1, wherein said fluorescent light bulb four substantially U-shaped glass tubes.

6. A fluorescent lamp lighting device according to claim 1, wherein said fluorescent light bulb includes a pair of electrode filaments.

7. A fluorescent lamp lighting device according to claim 6, wherein said a first of said pair of electrode filaments is held by a first pair of reed lines at a first location and a second of said pair of electrode filaments is held by a second pair of reed lines at a second location.

8. A fluorescent lamp lighting device according to claim 7, wherein each of said first and second pair of reed lines is electrically connected to an electronic lighting circuit.

9. A fluorescent lamp lighting device according to claim 1, further comprising an electronic lighting circuit including an inverter circuit section driven by a power supply so as to light the fluorescent light bulb.

10. A fluorescent lamp lighting device according to claim 9, wherein a pair of the negative temperature characteristic thermistors are surface mounted on the same surface of the electronic lighting circuit substrate.

11. A fluorescent lamp lighting device comprising:

a fluorescent light bulb having an electrode filament; and an electronic lighting circuit substrate for lighting the fluorescent light bulb; wherein a capacitor connected in parallel with said fluorescent light bulb, a positive temperature characteristic thermistor connected in parallel with the capacitor, and a negative temperature characteristic thermistor connected in parallel with said electrode filament are mounted on said electronic lighting circuit substrate;

said negative characteristic thermistor has a mounting surface that is mounted in such a manner that said mounting surface is in abutment with said electronic lighting circuit substrate; and said negative temperature characteristic thermistor is mounted on a fluorescent light bulb side of the electronic lighting circuit substrate.

12. A fluorescent lamp lighting device according to claim 11, wherein the positive temperature characteristic thermistor is mounted on a base side of the electronic lighting circuit substrate.

13. A fluorescent lamp lighting device according to claim 11, further comprising an external-tube glass bulb which covers the fluorescent light bulb.

14. A fluorescent lamp lighting device according to claim 13, further comprising a resin case connected to the external-tube glass bulb.

15. A fluorescent lamp lighting device according to claim 14, further comprising an electronic lighting circuit housed in the resin case.

16. A fluorescent lamp lighting device according to claim 11, wherein said fluorescent light bulb four substantially U-shaped glass tubes.

17. A fluorescent lamp lighting device according to claim 11, wherein said fluorescent light bulb includes a pair of electrode filaments.

18. A fluorescent lamp lighting device according to claim 17, wherein said a first of said pair of electrode filaments is held by a first pair of reed lines at a first location and a second of said pair of electrode filaments is held by a second pair of reed lines at a second location.

19. A fluorescent lamp lighting device according to claim 18, wherein each of said first and second pair of reed lines is electrically connected to an electronic lighting circuit.

20. A fluorescent lamp lighting device according to claim 11, further comprising an electronic lighting circuit including an inverter circuit section driven by a power supply so as to light the fluorescent light bulb.

21. A fluorescent lamp lighting device according to claim 20, wherein a pair of the negative temperature characteristic thermistors are surface mounted on the same surface of the electronic lighting circuit substrate.

22. A fluorescent lamp lighting device comprising:

a fluorescent light bulb having an electrode filament; and an electronic lighting circuit substrate for lighting the fluorescent light bulb; wherein a capacitor connected in parallel with said fluorescent light bulb, a positive temperature characteristic thermistor connected in parallel with the capacitor, and a negative temperature characteristic thermistor connected in parallel with said electrode filament are mounted on said electronic lighting circuit substrate;

said negative characteristic thermistor has a mounting surface that is mounted in such a manner that said mounting surface is in abutment with said electronic lighting circuit substrate; and said positive temperature characteristic thermistor is mounted on a fluorescent light bulb side of the electronic lighting circuit substrate.

23. A fluorescent lamp lighting device according to claim 22, wherein the negative temperature characteristic thermistor is mounted on a base side of the electronic lighting circuit substrate.

24. A fluorescent lamp lighting device according to claim 22, further comprising an external-tube glass bulb which covers the fluorescent light bulb.

25. A fluorescent lamp lighting device according to claim 24, further comprising a resin case connected to the external-tube glass bulb.

26. A fluorescent lamp lighting device according to claim 25, further comprising an electronic lighting circuit housed in the resin case.

27. A fluorescent lamp lighting device according to claim 22, wherein said fluorescent light bulb four substantially U-shaped glass tubes.

28. A fluorescent lamp lighting device according to claim 22, wherein said fluorescent light bulb includes a pair of electrode filaments.

29. A fluorescent lamp lighting device according to claim 28, wherein said a first of said pair of electrode filaments is held by a first pair of reed lines at a first location and a second of said pair of electrode filaments is held by a second pair of reed lines at a second location.

30. A fluorescent lamp lighting device according to claim 29, wherein each of said first and second pair of reed lines is electrically connected to an electronic lighting circuit.

31. A fluorescent lamp lighting device according to claim 22, further comprising an electronic lighting circuit including an inverter circuit section driven by a power supply so as to light the fluorescent light bulb.

32. A fluorescent lamp lighting device according to claim 31, wherein a pair of the negative temperature characteristic thermistors are surface mounted on the same surface of the electronic lighting circuit substrate.

* * * * *